United States Patent [19]

Hayashi

[11] 4,109,775

[45] Aug. 29, 1978

[54] COIN CONTROL CIRCUITRY FOR A VENDING MACHINE

[75] Inventor: Yukichi Hayashi, Sakado, Japan

[73] Assignee: Nippon Coinco Co., Ltd., Tokyo, Japan

[21] Appl. No.: 735,968

[22] Filed: Oct. 27, 1976

[51] Int. Cl.[2] ..... G07F 5/16

[52] U.S. Cl. ..... 194/10

[58] Field of Search ..... 194/10, 1 L, 1 M, 1 N

[56] References Cited

U.S. PATENT DOCUMENTS

| | | | |
|---|---|---|---|
| 3,023,874 | 3/1962 | Zindel | 194/10 |
| 3,526,308 | 9/1970 | Thomas | 194/10 |
| 3,703,229 | 11/1972 | Bowring | 194/10 |
| 3,828,903 | 8/1974 | Levasseur | 194/10 |

*Primary Examiner*—Stanley H. Tollberg

*Attorney, Agent, or Firm*—Spensley, Horn & Lubitz

[57] ABSTRACT

A vending machine capable of coping with changes in the kinds of vendible articles and a vend price in a very simple manner without modifying the coin control circuitry. The vender includes a plurality of switches and the vend price can be easily preset by suitably opening and closing these switches. Upon depression of a desired article selection switch of the vender, a set vend price signal corresponding to this switch is supplied to coin control circuitry in the form of a binary signal. The coin control circuitry compares the set vend price signal with amount of inserted coins and, when vending is possible, supplies a vend signal to the vender via a single line. The vender dispenses the selected article in response to depression of the article selection switch and receipt of the vend signal.

5 Claims, 2 Drawing Figures

Figure 1:
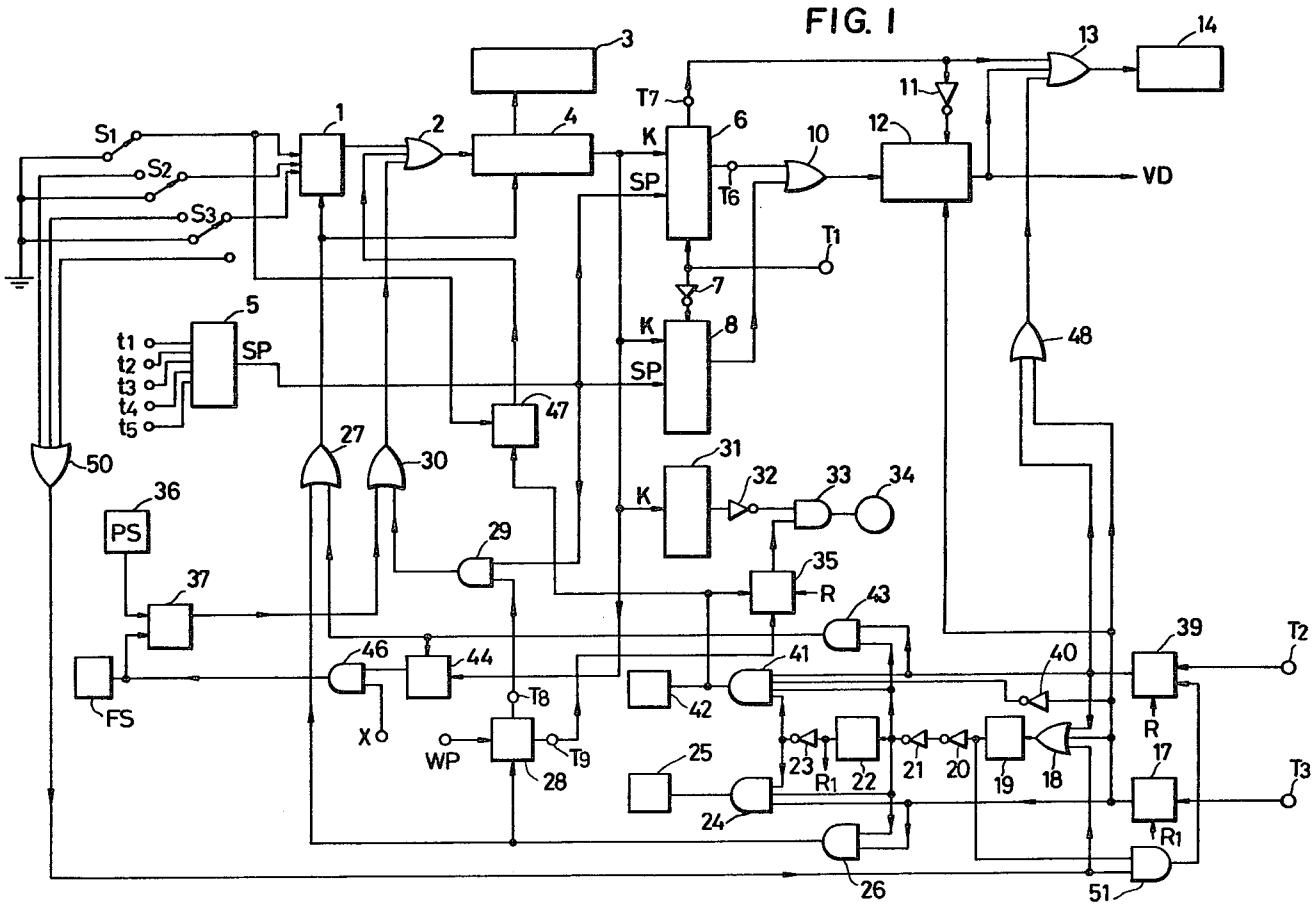

FIG. I
VD
SP
K
R
R1
WP
X
PS
FS
S1
S2
S3
t1
t2
t3
t4
t5
T1
T2
T3
T7
T8
T9
T16

COIN CONTROL CIRCUITRY FOR A VENDING MACHINE

This invention relates to a vending machine and, more particularly, to a vending machine capable of vending a plurality of articles under the control of single vend signal with simple construction of coin control section usable for various kinds of venders.

A vending machine for dispensing a plurality of sorts of goods is generally constructed to comprise a coin control section and a vender or article dispensing section. The coin control section functions to electrically count the amount of deposited coins and also to compare the counted value of the coins with a preset article vend price and has a unit for producing a vend signal when the amount of inserted coins is greater than the article vend price and a unit for paying out change coins thereafter. The article dispensing section has a plurality of article kind selection switches and a circuit for actuating an article dispensing mechanism on the condition that a corresponding vend signal is applied when any of the selection switches is manually depressed.

Since the conventional vending machine of aforementioned structure has a coin control section which includes various vend price presetting circuits and a comparison circuit for comparing the amount of inserted coins with the preset vend price in the coin control section, the constitution of the coin control section becomes very complicated. The construction of such coin control section should be revised in case wherein the kinds of vend articles are to be increased. In other words, the coin control section cannot be commonly utilized for various sorts of vender sections without revising the construction of the coin control section. In addition, since the vend signal from the coin control section to the vender section is applied through the respective lines thereto, the number of wires connected between the coin control section and the vender section becomes great many.

It is, therefore, an object of the present invention to provide a novel and useful vending machine which has eliminated the above described disadvantages of the prior vending machines.

It is another object of the present invention to provide a vending machine capable of vending a plurality of articles under the control of single vend signal.

It is another object of the invention to provide a vending machine incorporating a coin control section of simple construction usable for various kinds of venders.

It is another object of the invention to provide a vending machine incorporating extremely less wires connected between the coin control section and the vender section.

It is another object of the invention to provide a vending machine appropriate for mass production even for vending various kinds of commodities.

Figure 2:
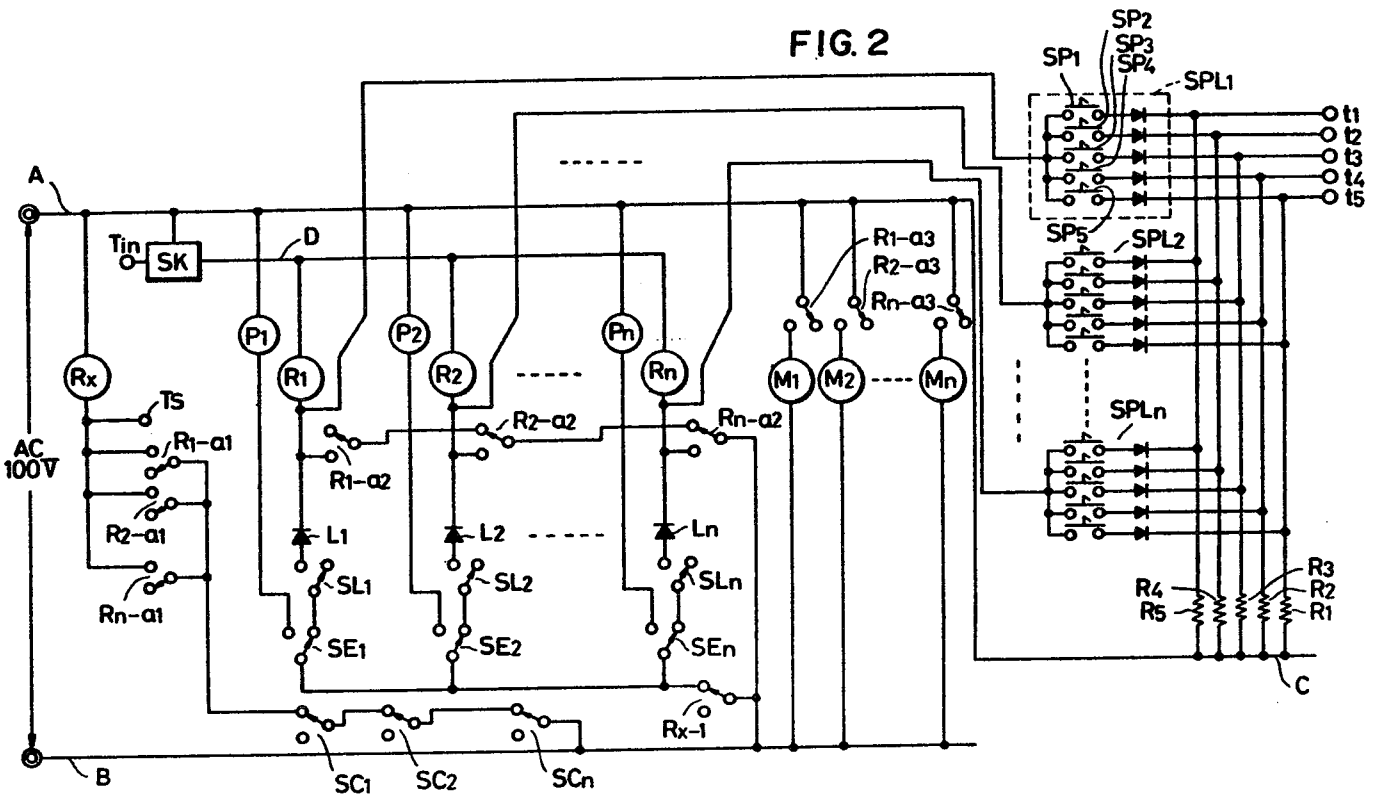

Other objects and features of the invention will become apparent from the description made hereinbelow with reference to the accompanying drawings, in which:

FIG. 1 is a block diagram schematically showing one preferred embodiment of the coin control section of the control system of the vending machine constructed according to the present invention; and FIG. 2 is a circuit diagram showing one preferred embodiment of the vender section of the control system of of the vending machine of the present invention.

Referring first to FIG. 1, which is a block diagram of one preferred embodiment of the coin control section of the present invention, wherein the following logic circuit will be described in term of positive logic in which a high level designates "1" and a low level designates "0", reference characters $S_1$, $S_2$ and $S_3$ respectively designate switches which respectively are actuated by passing coins sorted out by a coin acceptor (not shown) for detecting the insertion of the coin. In the illustrated embodiment, the switch $S_1$ is adapted to detect a 100 yen coin, the switch $S_2$ a 50 yen coin and the switch $S_3$ a 10 yen coin, respectively.

The signal corresponding to the inserted coin detected by any of the switches $S_1$, $S_2$ and $S_3$ is converted to binary information by a binary converter circuit 1 and the binary signal thus converted is applied through an OR circuit 2 to an addition and subtraction counter 4, which is adapted to count the total amount of the deposited coins upon completion of the insertion of the coins. The addition and subtraction counter 4 performs addition when the control input is "0", and performs subtraction when the control input is "1". Since the control input upon insertion of the coins is "0" as will become clear from the following description, it makes an addition. A display lamp 3 will display the numeral counted by the addition and subtraction counter 4.

When any of article selector switches $SL_1$ through $SL_n$ provided in the vender section (see FIG. 2) is depressed after a coin is inserted in the machine, signals SP corresponding to the set vend price of the article seleced is supplied in the form of binary information from the vendor section to the coin control section of the vending machine and is compared with the counted output value K of the addition and subtraction counter 4 in the comparison section. The comparison section comprises a comparison and storage circuit 6 and a comparison and storage circuit 8. The comparison and storage circuit 6 is used when 10 yen coins are retained in a change coin stacking tube (not shown), and the comparison and storage circuit 8 is adopted when no 10 yen coin is in the change coin stacking tube. The comparison and storage circuit 8 will produce its output signal "1" only when $K = SP$ and accordingly operate to vend the article merely when the count of the addition and subtraction counter 4 coincides with the set vend price but not to vend it when the change coin is necessary. A binary signal "1" is applied to a terminal $T_1$ only when the 10 yen coins are held in the change coin stacking tube (not shown) and the comparison and storage circuit 6 is performed by this signal "1", whereas since this signal "1" is inverted by an inverter 7 to "0" which is applied to the comparison and storage circuit 8, the latter circuit 8 is not operated. A binary signal "0" is supplied to the terminal $T_1$ when no 10 yen coin is in the change coin stacking tube (not shown). Accordingly, the comparison and storage circuit 6 is not acted but the comparison and storage circuit 8 is acted.

For convenience of explanation, the following operation will be described on the condition that the 10 yen coins are contained in the change coin stacking tube (not shown).

The comparison circuit 6 is constructed to compare the set vend price signal SP with the counted value K from the addition and subtraction counter 4 and thereby produces its output "1" at a terminal $T_6$ when $SP \leqq K \leqq SP + 90$ and produces its output "0" when $K > SP + 90$, and also produces its output "1" at a terminal $T_7$ only when $K > SP + 90$. More particularly, if a vend price for a single piece of the article is set at 120 yen and two 100 yen coins are introduced in the machine, the condition of $SP \leqq K \leqq SP + 90$ is satisfied with the result that a signal "1" is applied to the terminal $T_6$. This signal "1" at the terminal $T_6$ is applied through an OR gate or circuit 10 to a vender control circuit 12, which stores this signal "1" and thereupon produces a vend signal VD. In case of $K > SP + 90$, more than necessary change coins must be paid out upon vending, and therefore no vending is allowed. For example, if a vend price for a single piece of the article is set at 120 yen and 250 yen are inserted in the machine, since the signal at the terminal $T_6$ becomes "0", the comparison circuit 6 will not produce the vend signal VD. Whereupon, the signal "1" produced at the terminal $T_7$ from the comparison circuit 6 is applied through an OR gate or circuit 13 to a reject unit 14. The reject unit 14 functions to prohibit the coins to be inserted any further upon receipt of the signal therefrom. It should be noted that the coins once inserted in the machine will, of course, be returned by the returning operation as will be hereinafter described in greater detail.

FIG. 2 is a circuit diagram showing one preferred embodiment of the vender section of the vending machine. The vender section comprises article selector switches $SL_1$ through $SL_n$ corresponding to different kinds of vend goods. When the purchaser depresses desired selector switch of the switches $SL_1$ through $SL_n$, the signal corresponding to the set vend price of the selected article is produced in a form of binary information and the vend signal VD is received from the coin control section as has been described previously, and a vend start signal represending that the vending action of the selected article is being started is simultaneously produced, whereupon the selected article is being dispensed from the machine.

The production of the set vend price signal will at first be described.

The setting of the vend price is conducted by vend price presetting circuits $SPL_1$ through $SPL_n$. The vend price presetting circuit $SPL_1$ is commonly connected together at one end and are connected respectively through diodes to common output terminals $t_1$ through $t_5$ at the other end of manually reset type switches $SP_1$ through $SP_5$, respectively. The switch $SP_1$ corresponds to the 10 yen coin, the switch $SP_2$ to 20 yen, the switch $SP_3$ to 40 yen, the switch $SP_4$ to 80 yen and the switch $SP_5$ to 160 yen in such a manner that setting of 10 yen to 310 yen can be conducted by suitably depressing any combination of these switches $SP_1$ through $SP_5$ so as to close the switches. It should be understood from the foregoing description that the other vend price presetting circuits $SPL_2$ through $SPL_n$ are also similarly constructed to be connected at the respective output sides to the common output terminals $t_1$ through $t_5$, respectively. Accordingly, the respective switches of the vend price presetting circuits corresponding to the different sorts of goods can be suitably depressed so as to preset the vend price of the respective kinds of articles. For example, in order to set 120 yen at the vend price presetting circuit $SPL_1$, the presetting switches $SP_3$ and $SP_4$ may be depressed to be closed.

When the purchaser depresses the selector switch $SL_1$ after he inserted the coins as has previously described, an electric current will flow from a line B through a relay contact R*x*-1, an article shortage switch $SE_1$, a diode $L_1$, the switches $SP_3$ and $SP_4$ of the vend price presetting circuit $SPL_1$, resistors $R_3$ and $R_4$ to a line C. Accordingly, the voltage of the terminals $t_3$ and $t_4$ will become high level while that of the terminals $t_1$, $t_2$ and $t_5$ will become low level. Thus, a parallel binary signal 01100 will be produced from the terminals $t_5$ through $t_1$. This binary signal expresses the vend price of the article corresponding to the selector switch $SL_1$ and is thereafter applied to the coin control section.

It should be also understood from the foregoing description that when the other selector switches $SL_2$ through $SL_n$ are depressed to be closed, the signal corresponding to the vend price of the respective goods will also be produced in the same manner as the selector switch $SL_1$.

It should also be appreciated that if the range of the amount of the vend price of the article is desired to be broadened any further, only number of the parallel switches is increased in the same manner as above.

If the selector switch $SL_1$ is thus depressed to be closed, the vend price signal is delivered to the coin control section, is thereafter compared with the counted valve K from the addition and subtraction counter 4, and the vend signal VD is applied to a terminal Tin when $Sp \leqq K \leqq SP + 90$ in such a manner that these actions are instantaneously conducted during closure of the switch $SL_1$.

When the vend signal VD is thus applied to the terminal T*in*, a switching circuit SK will connect a line D to a line A. Accordingly, an electric current will flow from the line B through the relay contact R*x*-1, the switch $SE_1$, the switch $SL_1$, the diode $L_1$, relay coil $R_1$ and the line D to the line A, so that the relay coil $R_1$ is thus energized. Therefore, relay contacts $R_{1\text{-}a1\ to\ a3}$ are transferred to the other side from that shown in FIG. 2. The relay contact $R_{1\text{-}a2}$ is for self-holding, so that even if the switch $SL_1$ is opened the relay coil $R_1$ remains energized. When the contact $R_{1\text{-}a1}$ is closed, an electric current will flow through a carrier switch $SC_1$, the contact $R_{1\text{-}a1}$, relay coil R*x* so as to energize the relay coil R*x* with the result that a vend start signal VO is produced from a terminal T*s*. Simultaneously, when the relay contact $R_{1\text{-}a3}$ is closed, an article dispensing motor is started to be energized or driven.

The carrier switches $SC_1$ through $SC_n$ correspond to the respective article dispensing motors $M_1$ through $M_n$ and open when the article is completely dispensed. Accordingly, when the motor $M_1$ finishes the dispensing action of the article, the switch $SC_1$ is opened so that the relay coil R*x* is deenergized with the result that the contact R*x*-1 is thus closed.

The article shortage switch $SE_1$ is opened when the corresponding good is in shortage so as to display the shortage of the article by lighting a lamp $P_1$ to disconnect completely the switch $SL_1$ from the line B. Accordingly, even if the selector switch $SL_1$ is depressed, corresponding vend price signal is not delivered out.

It should be understood from the foregoing description that although the above described operation has been described with respect to the selector switch $SL_1$, the other selector switches $SL_2$ through $SL_n$ are similarly constructed and operated in the same manner as the switch $SL_1$. That is, $SC_2$ through $SC_n$ designate carrier switches, $SE_2$ through $SE_n$ articles shortage switches, $R_2$ through $R_n$ relay coils, $R_{2\text{-}a1\ to\ a3} \cdots R_{n\text{-}a1\ to\ a3}$ relay contacts, and $M_2$ through $M_n$ article dispensing motors.

When the vend signal is thus applied to the vender section as above described, the article dispensing action is started in a mechanical manner, temporarily retained coins are simultaneously received, the amount of change coin is calculated, and the change coins are paid out. These actions will be performed in the coin control section, which will now be described.

The vend start signal produced at the terminal of the vender section is applied to the terminal $T_3$.

When the vend start signal VO from the vender section is applied to the terminal $T_3$, the signal VO is stored in a memory 17. The signal VO stored in the memory 17 is applied through an OR gate or circuit 18 to a timer 19 so as to thereupon start delay action of the timer 19. After a predetermined delay action, the signal "1" produced from the timer 19 is applied through inverters 20 and 21 to a timer 22 to thereupon start delay action of the timer 22. Upon completion of the timer 22 by the signal "1", an output signal "1" is also produced and is then inverted by an inverter 23 so as to become a signal "0".

Since and gate or circuit 24 receives at one input the vend start signal VO from the memory 17, at second input the signal from the inverter 21 and at the other input the signal from the inverter 23, the AND gate will gate out its output signal while the vend start signal VO is applied thereto and the timer 22 is being operated. Accordingly, at this time the AND gate 24 will produce an output signal "1" to an accept solenoid control unit 25 so that the temporarily retained coins are received in the coin stacking tube.

The accept solenoid control unit 25 and a return solenoid control unit 42 (both not shown) form a pair and function to temporarily retain the coins of maximum amount and kind or denomination of inserted coins (100 yen coin in this embodiment) in a mechanical manner for the case when the return switch is depressed and to deliver the temporarily retained coins to a return outlet by the operation of the return solenoid control unit 42 when the return switch is depressed and to a cash box by the operation of the accept solenoid control unit 25 when the vend start signal VO is applied.

Since an AND gate or cicuit 26 receives at one input the vend start signal VO from the memory 17 and at the other input the signal from the inverter 21, the AND gate will produce an output signal "1" while the timer 19 is producing its output and the memory 17 is reset by the output $R_1$ of the timer 22.

When the AND gate 26 produces an output "1", this output signal "1" is applied through an OR gate 27 to the control input of the addition and subtraction counter 4 which thereupon makes a subtraction so as to start subtraction operation.

This output signal "1" from the AND gate 26 is also applied through the OR gate 27 to the binary converter circuit 1 so as to prohibit to produce its output even if the coins are erroneously inserted in the machine. Further, the output signal "1" from the AND circuit 26 is also applied to a memory 28, which thereupon produces a signal "1" to an AND gate or circuit 29. Since the AND gate 29 receives at the other input the set vend price signal SP, the AND gate 29 will produce an output, which is applied through an OR circuit 30 and the OR circuit 2 to the addition and subtraction counter 4 so as to subtract the set vend price from the total amount of the coins inserted. When the counted value of the addition and subtraction counter 4 becomes 0, the article vending action is completed so that a reset signal R is then produced so as to reset all the memories in the circuit arrangements of the control system of the vending machine. However, assume that the counted value of the addition and subtraction counter 4 does not become 0 when the set vend price is subtracted from the total amount of the inserted coins, i.e., in case of $K>0$, payout of change coins is necessary. The change payout action will now be described hereinbelow. The signal applied from the memory 17 to the vender control circuit 12 may function to cause the control circuit 12 to retain the signal from the comparison and storage circuit 6 when the signal from the memory 17 is "1" and to reset to completely stop the vend signal when it is "0", so as to prevent twice dispensing of the goods.

Change Payout Action

As clear from the foregoing description, the counted value of the addition and subtraction counter 4 corresponds to the amount subtracted by the set vend price from the total amount of the inserted coins, i.e., the amount of change coins. The counted value K of the addition and subtraction counter 4 is applied to a comparison circuit 31, which compares in such a manner as $K>0$, $K = 0$. In case of $K>0$, the comparison circuit will produce an output signal "0", which is inverted by an inverter 32 and is thereafter applied to one input of an AND gate or circuit 33, which receives at the other input the signal from a memory 35. The memory 35 is adapted to receive a set signal "1" from a terminal $T_9$ of the memory 28 after the signal "1" is applied from the memory 28 at the output terminal $T_8$ to the AND gate 29, i.e., after the set vend price is subtracted from the total amount of the inserted coins in the addition and subtraction counter 4. Accordingly, the AND gate 33 receives both the inputs after the change payout condition so as to actuate a change coin motor 34. The coins returned by the motor 34 is counted by a change coin pulse switch 36 and the counted value of the returned coins by the pulse switch 36 is converted to a binary code by a binary converter circuit 37 and is then applied through an OR circuit 30 and the OR circuit 2 to the addition and subtraction counter 4, so that this counted value is subtracted from the counted value output K of the addition and subtraction counter 4. This action is continued until the output K of the addition and subtraction counter 4 becomes zero. When $K = 0$, the signal from the inverter 32 becomes "0". Accordingly, one input of the AND gate 33 thus becomes zero to cause the change coin motor 34 to be stopped so that all the memories in the circuit arrangement of the control system are reset by the reset signal R produced as previously described so as to complete the change payout action.

Coin Return Action

The coin return action will now be hereinbelow described in case wherein the return switch is depressed and the signal "1" is applied to the terminal $T_2$.

In case wherein the coins have been deposited in the machine and the selector switch of the goods is not depressed but return switch is depressed, this signal "1" is applied to the terminal $T_2$ and is stored in a memory 39 and is then applied through the OR gate 18 to the timer 19. This signal "1" is also simultaneously applied to an AND circuit 41 at one input. The AND circuit 41 receives at second input the signal from an inverter 40, at third input the signal from the inverter 21 and at the other input from the inverter 23, and will produce an output only while the timer 22 is acted. When the AND gate 41 produces its output, it actuates the return solenoid control unit 42 so as to deliver the temporarily retained coins to the return outlet. In the meanwhile, since an AND circuit 43 receives at one input the signal from the memory 39 and at the other input the signal from the inverter 21, it will produce an output only when the timer 19 produces its output. This signal "1" is applied through the OR gate 27 to the addition and subtraction counter 4 at the control input so as to make subtraction thereafter.

A control unit 44 functions to determine whether the counted output value K of the addition and subtraction counter 4 is the numerical value more or less than the value corresponding to 50 yen and to produce a signal "1" to an AND circuit 46 by the signal "1" from the AND gate 43 when $K \geqq 50$. The and gate receives at the other input the signal X for detecting whether there is 50 yen coin in the coin stacking tube (not shown) or not. Accordingly, the AND circuit 46 will produce an output when there is a coin in the coin stacking tube, so as to energize a 50 yen coin payout solenoid FS and to thereby deliver the 50 yen coin to the return outlet. Simultaneously, the output "1" of the AND gate 46 is converted to a binary code by the binary converter circuit 37 and is then applied through the OR gate 30 and the OR gate 2 to the addition and subtraction counter 4 so as to make subtraction of 50 yen from the counted value. Further, it is also necessary to subtract the amount of the coins returned by the action of the aforementioned return solenoid control unit 42 from the counted value of the addition and subtraction counter 4. This action is conducted by storing 100 yen coin insertion signal "1" of the switch $S_1$ by a 100 yen coin insertion storage control circuit 47, feeding the signal from the 100 yen coin insertion storage control circuit 47 to the addition and subtraction counter 4 when the signal "1" is applied from the AND circuit 41 at this time and by subtracting the 100 yen from the counted value of the addition and subtraction counter 4. After the 50 yen coin and the 100 yen coin are returned, the counted value of the residual change of the addition and subtraction counter 4 is returned by the 10 yen coins. Since the memory 35 is set by the signal from the AND circuit 41, the change coin motor 34 is acted thereby and the residual change is returned in the same manner as the change payout action thereafter so as to complete it when the counted value of the addition and subtraction counter 4 becomes 0.

Since the OR gate 13 receives at one input the signal from the terminal $T_7$ of the comparison and storage circuit 6, at second input the signal from the vender control circuit 12 and at the other input the signal from an OR gate circuit 48 and the OR gate 48 receives at one input the signal from the memory 17 and at the other the signal from the memory 39, the signal "1" is applied to the control unit 14 when the amount of the inserted coins is more than SP + 90, when the vend signal is produced, when the return switch is depressed or when the vend start signal is applied, a pin is projected into the coin insertion slot so as to prohibit the coins to be inserted any further even if the coins are further deposited and to be returned to the return outlet.

When the switches $S_1$, $S_2$ and $S_3$ are all closed, the signal "1" is applied to the respective inputs of an OR gate circuit 50. The output of the OR gate 50 is applied to an AND circuit 51 and is simultaneously delivered through the OR gate 18 and the timer 19 to be delayed by a predetermined time, and the delayed signal is also applied to the other input of the AND circuit 51. Accordingly, when the switches $S_1$, $S_2$ and $S_3$ continue to be closed for a predetermined time, the AND gate 51 will produce an output, which is applied to the memory 39 so that the inserted coins are automatically returned. More particularly, this circuit will detect the defective coin insertion slot and insertion of foregin manner in the slot.

The circuit arrangement constructed such that the signal "1" is produced at the terminal $T_6$ of the comparison and storage circuit 6 in case of $SP \leqq K \leqq SP + 90$ and the signal "1" is produced at the terminal $T_7$ of the comparison and storage circuit 6 in case of $K > SP + 90$ in the above described embodiment is adapted to prevent the machine to be used as money exchange machine without paying out the change coins more than the difference of the coins between the maximum and minimum amount and denominations to be used in the vending machine (100 yen − 10 yen = 90 yen in this embodiment). Accordingly, assume that the difference of the coins between the maximum and minimum amount and denominations to be used is represented by L, it can be generally noted that the circuit arrangement is so constructed that the signal "1" is produced at the terminal $T_6$ of the comparison circuit 6 in case of $SP \leqq K \leqq SP + L$. That is, the reference character L can be arbitrarily determined depending upon the kinds or sorts of the coins or notes to be used in the vending machine.

It will be understood from the foregoing description that since the vending machine of the present invention is thus constructed as described above, it is simply constructed with one comparison circuit for comparing the set price delivered from the set vend price circuit provided in the vender section with the total amount of the inserted coins in the coin control unit and the same coin control unit can be use for various kinds merely changing the constitution of the vender section even if the kinds of the articles are increased and the circuit arrangement of the coin control unit can also be simplified.

It will be also understood from the foregoing description that although the vend signals delivered to the vender section must need the number corresponding to the kinds of the goods in the conventional machine, only one signal may be sufficient in the vending machine of the present invention, the wires for connecting the coin control unit and the vender section may be only three for delivering the vend signal, the vend start signal and the set vend price signal and the circuit construction of the vender section may also be simplified. It will also be understood that since the coin control unit and the vender section can be freely combined in various combination for usage, they can be manufactured in mass production separately in high efficiency, and its productivity may be highly improved.

What is claimed is:

1. In a vending machine including coin control means for controlling the counting of inserted coins, calculation of change coin, payout of change coin and return of coin, and vender means for dispensing articles based on the signal from said coin control means, the improvement wherein;

said vender means comprises:

setting means for individually setting vend prices of respective articles; and means for generating, upon depression of an article selection switch, a binary coded set vend price signal corresponding to said article selection switch: wherein said coin control means comprises:

inserted coin encoding means for counting inserted coins and for producing binary coded signals indicative thereof, a binary addition/subtraction circuit conditioned during coin insertion to add the binary coded signals indicative of inserted coins so as to produce a binary sum corresponding to the total value of said inserted coins, comparator means for producing, upon comparison of said binary coded set vend price signal from said vender means with the binary sum from said addition/subtraction circuit corresponding to the value of inserted coins, a vend signal when vending is possible: and wherein;

said vender means further comprises:

means for starting dispensing of the article when said selection switch has been depressed and said vend signal has been received, and subtraction enabling means, actuated when dispensing of said article has started, for conditioning said addition/subtraction circuit to subtract from the binary sum corresponding to the value of inserted coins the binary coded vend price signal, said comparator means thereafter producing a change enabling signal if the difference is greater than zero, indicating that change must be dispensed.

2. A vending machine as defined in claim 1 wherein said setting means comprises a plurality of switches which are commonly connected to a power source at one terminal thereof upon closure of a corresponding one of said article selection switches and which are settable so as to generate said binary coded set vend price signal.

3. A vending machine as defined in claim 1 wherein said means for starting dispensing of the article comprise:

a relay circuit corresponding to each article;

means for connecting one line of the power source to one terminal of said relay circuit through said article selection switch;

a switching circuit actuated only by means of the vend signal from said coin control means for connecting other line of the power source to other terminal of said relay circuit; and means for starting an article dispensing motor by energization of the relay of said relay circuit.

4. A vending machine as defined in claim 1 further comprising:

change dispensing means, actuated by said change enabling signal, for dispensing coins as change, dispensed coin encoding means for producing binary coded signals indicative of the value of coins dispensed as change, circuit means for conditioning said addition/subtraction circuit, in response to the dispensing of coins as change, to subtract said signals indicative of the value of coins dispensed as change from the difference between the sum corresponding to the value of inserted coins and the vend price signal, said change enabling signal being terminated when the result of said subtraction becomes zero indicating that the correct change has been dispensed.

5. A vending machine as defined in claim 1 wherein said comparator means comprises:

excess coin comparison circuitry for comparing the binary sum from said addition/subtraction circuit corresponding to the value of inserted coins with the sum of the set vend price plus a value L equal to the difference between the values of the largest and smallest denomination coins acceptable by said vending machine, and for inhibiting production of said vend signal when the value of inserted coins is equal to or greater than said sum.

* * * * *